United States Patent [19]

O'Daniel

[11] Patent Number: 4,815,287

[45] Date of Patent: Mar. 28, 1989

[54] BEVERAGE COOLER APPARATUS

[76] Inventor: John D. O'Daniel, 4766 James Kent Ct. W., Memphis, Tenn. 38118

[21] Appl. No.: 150,919

[22] Filed: Feb. 1, 1988

[51] Int. Cl.[4] ..... F25D 11/00

[52] U.S. Cl. ..... 62/430; 62/438; 62/457; 62/529

[58] Field of Search ..... 62/457, 529, 530, 430, 62/438

[56] References Cited

U.S. PATENT DOCUMENTS

| | | | |
|---|---|---|---|
| 1,771,186 | 7/1930 | Mock | 62/457 |
| 3,302,427 | 2/1967 | Stoner et al. | 62/529 X |
| 3,302,428 | 2/1967 | Stoner et al. | 62/457 |
| 3,715,895 | 2/1973 | Devlin | 62/457 |
| 4,183,226 | 1/1980 | Moore | 62/457 |
| 4,570,454 | 2/1986 | Campbell | 62/457 |
| 4,612,781 | 9/1986 | Swerdon | 62/457 |

FOREIGN PATENT DOCUMENTS

| | | | |
|---|---|---|---|
| 802813 | 6/1936 | France | 62/457 |

*Primary Examiner*—Lloyd L. King
*Attorney, Agent, or Firm*—Leon Gilden

[57] ABSTRACT

A beverage cooler apparatus is set forth wherein a hollowed walled container has a removable plug positioned within a recess through a bottom portion thereof enabling introduction of a freezeable fluid within the hollow walls of said container. Optionally a coiled spring may be positioned within the hollow interior of the beverage core apparatus for securement of an associated beverage container in use with non-hardening cooling gels or subsequent to thawing of a freezeable fluid within the hollow walls.

1 Claim, 1 Drawing Sheet

BEVERAGE COOLER APPARATUS

BACKGROUND OF THE INVENTION

1. Field of the Invention

The field of invention relates to beverage coolers, and more particularly pertains to a new and improved beverage cooler apparatus wherein the same has positionable therein a hollow chamber in surrounding relationship to an associated container for maintaining cooling of said container.

2. Description of the Prior Art

The use of beverage cooling apparatus is well known in the prior art. As may appreciated, these devices have normally been of limited effectiveness in maintaining the cooling of beverages presented within such containers. Conventionally it has been desirable to construct such containers of durable and effective organization to enable use of such containers under a variety of conditions and physical treatment. For example, U.S. Pat. No. 2,526,165 presents a variety of cooling containers wherein compartmentalized storage of cooling liquid of various configurations is set forth. The cooling container of Smith, however, fails to set forth any means of continuously securing a conventional cylindrical container therein and maintaining such engagement of containers under varying conditions, as opposed to the instant invention utilizing an internal spring for the maintaining of frictional securement of containers within the cooling apparatus.

U.S. Pat. No. 3,580,762 to Zumstein sets forth the formation of double-walled plastic articles of potential use for cooling of items positioned therein but of construction an intent relatively remote from the instant invention.

U.S. Pat. No. 3,755,030 to Doman, et al., sets forth a cooling container wherein a permanently captured cooling medium is secured within a hollow walled vessel positionable within a surrounding jacket for the maintaining of products and the like cooled within the confines of the apparatus. The Doman patent, however, fails to set forth a means of replenishing the fluid supply and varying the fluid therein and furthermore fails to provide any means for maintaining capture of a cylindrical container within the apparatus, as opposed to the intent and organization of the instant invention.

U.S. Pat. No. 3,766,975 to Todd presents a drinking receptacle wherein an outer shell of insulating material wherein a heat transfer medium is positioned for absorption from hot fluids positioned within the container to reduce the temperature of such fluids within the container and maintain the reduced level of temperature for extended periods of time. While of interest generally to an organization including fluid trap layer, the Todd patent fails to provide means for replenishing or restoring the fluid supply within the hollow walls of the container and furthermore fails to provide organization for the maintaining of frictional engagement with a cylindrical container positioned within the apparatus, as opposed to the instant invention.

U.S. Pat. No. 3,810,557 to Cline presents another drinking vessel wherein a hollow cylinder is sealed at its bottom and open at the top with an opening in an exterior wall for the presentation of a liquid to be frozen within the walls of the container. The Cline patent fails to provide means for permanently capturing the fluid therein and fails to provide a recessed plug for this purpose. Furthermore, as in other prior art, the Cline patent fails to provide means for the maintaining of frictional engagement with a separate container positioned within the apparatus.

As such, it may be appreciated that there is a continuing need for a new and improved beverage cooling apparatus which addresses both the problem of portability and effectiveness, and in this respect, the present invention substantially fulfills this need.

SUMMARY OF THE INVENTION

In view of the foregoing disadvantages inherent in the known types of beverage cooling apparatus now present in the prior art, the present invention provides an beverage cooling apparatus wherein the same may be efficiently utilized and including means for the inclusion of selective cooling mediums therein and of further employment of frictional maintaining means positionable within the hollow walls of the associated apparatus. As such, the general purpose of the present invention, which will be described subsequently in greater detail, is to provide a new and improved beverage cooling apparatus which has all the advantages of the prior art beverage cooling apparatus and none of the disadvantages.

To attain this, the present invention comprises a beverage cooling container which may be efficiently utilized during periods of use wherein a hollow walled container has positioned within a recessed floor region, a removable plug for the introduction of selective cooling fluids within the hollow walls of the container. Furthermore, the apparatus may include a frictional encircling spring within the hollow walls of the container for securement of separate containers positioned within the apparatus subsequent to the thawing of a coolant medium within the hollow walls. The coolant container apparatus so constructed provides the advantage of utilizing selective coolant mediums and furthermore providing means for enhancing the frictional securement of separate containers positioned within the cooling apparatus of the instant invention.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved beverage cooling apparatus which has all the advantages of the prior art beverage cooling apparatus and none of the disadvantages.

It is another object of the present invention to provide a new and improved beverage cooling apparatus which may be easily and efficiently manufactured and marketed.

It is a further object of the present invention to provide a new and improved beverage cooling apparatus which is of a durable and reliable construction.

An even further object of the present invention is to provide a new and improved beverage cooling apparatus which is susceptible of a low cost of manufacture with regard to both materials and labor, and which accordingly is then susceptible of low prices of sale to the consuming public, thereby making such beverage cooling apparatus economically available to the buying public.

Still yet another object of the present invention is to provide a new and improved beverage cooling apparatus which provides in the apparatuses and methods of the prior art some of the advantages thereof, while simultaneously overcoming some of the disadvantages normally associated therewith.

Still another object of the present invention is to provide a new and improved beverage cooling apparatus which includes a removable plug means for the introduction of various cooling mediums within the hollow walls of the associated apparatus.

An even further object of the present invention is to provide a new and improved beverage cooling apparatus wherein a helical spring is captured from the hollow walls of the coolant apparatus for maintaining securement of beverages positioned therein for extended use of the coolant apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
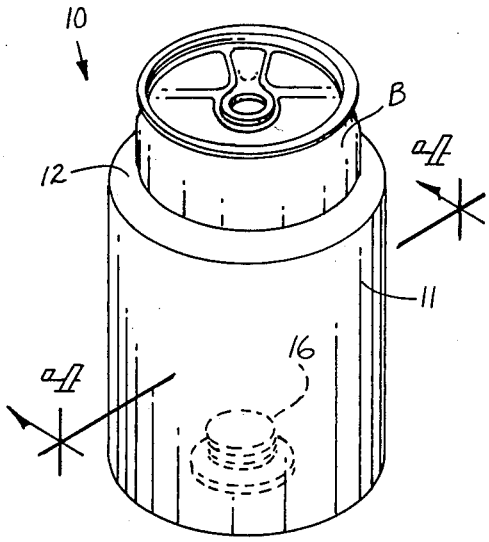
FIG. 1 is an isometric illustration of the instant invention illustrating the positioning of a beverage container within the cavity portion of the instant invention.
Figure 2:
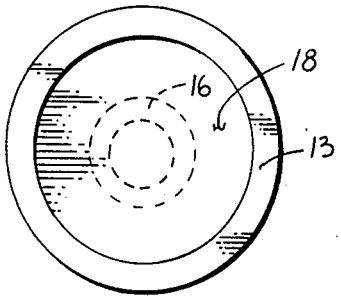
FIG. 2 is a top orthographic view of the instant invention.
Figure 3:
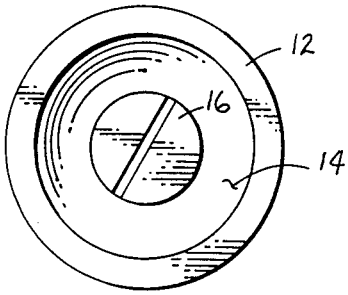
FIG. 3 is a bottom orthographic view of the instant invention.
Figure 4:
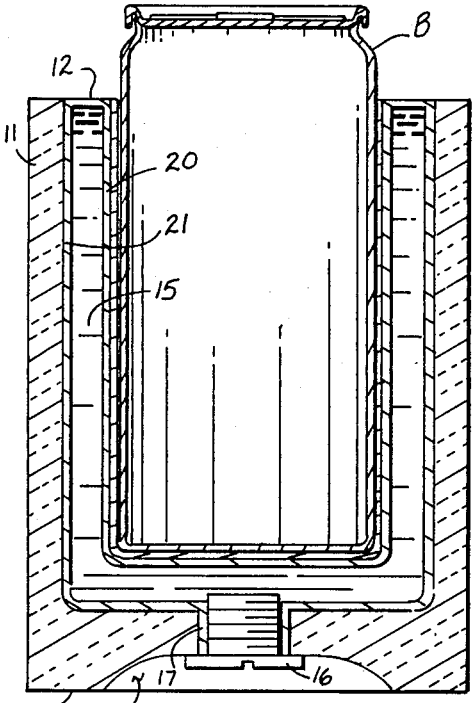
FIG. 4 is an orthographic view taken in elevation to the lines 4—4 of FIG. 4 in the direction indicated by the arrows.

With reference now to the drawings, and in particular to FIGS. 1 to 5 thereof, a new and improved beverage cooling apparatus embodying the principles and concepts of the present invention and generally designated by the reference numeral !0 will be described.

More specifically, it will be noted that the beverage cooling apparatus 10 essentially comprises an outer cylindrical wall 11 terminating upwardly into a generally orthogonal planar rim 12. The lowermost portion of outer cylindrical wall 11 terminates in a base 1S formed with a concave recess I4.

An inner cylindrical wall 20 cooperates with the exterior construction noted including the outer cylindrical wall 11, the planar rim 12, and the base 13 to define a hollow wall cavity 15 wherein freezeable fluids are presented for the cooling of an inserted beverage container "B", as illustrated in FIG. 1. A threaded plug 16 is securable within a complementarily threaded bore 17 for the selective introduction of various fluids therein subsequent freezing, such as in a refrigerator ice box for subsequent use with the aforenoted beverage container.

The beverage container "B" is positioned within the container conforming cavity 18 of the beverage cooling apparatus 10 and is frictionally securable therein by the engagement of the foam-like exterior covering comprising the outer cylindrical wall 11. Generally, a liner 21 formed of a generally rigid material, such as a plastic-like or metallic substance to provide rigidity to the apparatus 10. Furthermore, the use of a relatively rigid liner 21 forming the inner cylindrical wall 20 also enables the threaded bore 17 to maintain its structural integrity in use.

Figure 5:
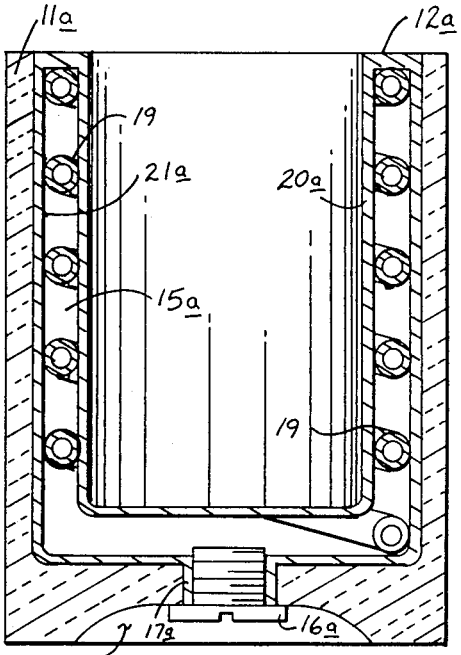
FIG. 5 is an orthographic sectional view taken in elevation of the instant invention illustrating the optional use of frictional engagement spring within the hollow walls of the instant invention.

Attention to FIG. 5 illustrates a modification of the instant invention wherein a helical spring 19 is positioned within the confines of hollow wall cavity **15*a* defined between the outer and inner cylindrical liner portions 21*a* and 20*a* respectively. In this embodiment, the cylindrical liners are formed of a much more pliant material to enable the helical spring is to effect frictional engagement with an inserted beverage container "B". The modification, as presented in FIG. 5, is contemplated for use with freezeable gels that remain somewhat fluid even during their exposure to freezing temperature to enable the spring 19 to cooperate through the inner cylindrical liner 28** for engagement of inserted beverage container "B".

As in the first modification, an outer foam-like cylindrical wall **11*a* terminates in an upper planar rim 12*a* and a base portion 13*a* formed With a concave recess 14*a*. Also a threaded plug 16*a* cooperates within threaded bore 17*a*** for the introduction of the aforenoted freezeable gel.

As to the manner of usage an operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beverage cooling apparatus to maintain cooling of portable, cylindrical beverage containers positionable therein comprising a "U" shaped container means for the acceptance of said cylindrical beverage containers including an outer cylindrical wall, an upper rim, and a base portion;

an inner "U" shaped cylindrical wall integrally secured to said upper rim defining a "U" shaped hollow wall cavity for the acceptance of fluid means therein for subsequent chilling of said fluid means to maintain said beverage containers at reduced temperatures, and wherein said upper rim is orthogonal and of generally planar configuration relative to said outer cylindrical wall, and wherein said outer cylindrical wall defines a foam-like material including an inner line cooperating with said inner "U" shaped cylindrical wall to define said "U" shaped hollow wall cavity, and wherein said base portion includes a concave recess formed with a threaded plug threadedly receivable with a threaded bore for the selective introduction of various fluid cooling medium in said hollow cavity, wherein a helical spring is positioned within said "U" shaped hollow wall cavity for the enhanced frictional engagement of cylindrical beverage containers, and wherein said fluid means comprises a non-hardening cooling gel, and wherein said beverage cooling apparatus is of a height less than that of said cylindrical beverage container for the manipulation of said container relative to said cooling apparatus.

* * * * *